US007695343B2

(12) United States Patent
Nobbs

(10) Patent No.: US 7,695,343 B2
(45) Date of Patent: Apr. 13, 2010

(54) BRASSIERE

(75) Inventor: Mulford J. Nobbs, Hacienda Heights, CA (US)

(73) Assignee: Jeunique International, Inc., City of Industry, CA (US)

( * ) Notice: Subject to any disclaimer, the term of this patent is extended or adjusted under 35 U.S.C. 154(b) by 51 days.

(21) Appl. No.: 11/613,992

(22) Filed: Dec. 20, 2006

(65) Prior Publication Data

US 2008/0153389 A1 Jun. 26, 2008

(51) Int. Cl.
*A41C 3/00* (2006.01)

(52) U.S. Cl. ..... 450/33; 450/60; 450/61

(58) Field of Classification Search ..... 450/36–38, 450/54–58, 11, 30, 33, 59–61
See application file for complete search history.

(56) References Cited

U.S. PATENT DOCUMENTS

| | | | | |
|---|---|---|---|---|
| 2,725,563 | A | 12/1955 | Rich | |
| 3,033,206 | A | 5/1962 | Ramsell | |
| 3,066,676 | A * | 12/1962 | Kaupp | 450/58 |
| 3,213,462 | A | 10/1965 | Ramsell | |
| D203,500 | S | 1/1966 | Nobbs | |
| 3,642,009 | A | 2/1972 | Nobbs | |
| 3,826,266 | A * | 7/1974 | Alpert | 450/11 |
| D232,785 | S | 9/1974 | Nobbs | |
| 3,890,978 | A | 6/1975 | Nobbs | |
| 4,091,819 | A | 5/1978 | Huber et al. | |
| 4,527,990 | A * | 7/1985 | Sigl | 604/385.29 |
| 5,664,984 | A * | 9/1997 | Laughridge | 450/57 |
| 6,332,825 | B1 * | 12/2001 | Henricksen | 450/81 |
| 6,572,437 | B1 * | 6/2003 | Waitz | 450/1 |
| 6,866,558 | B2 * | 3/2005 | Luciano et al. | 450/36 |
| 6,994,606 | B2 * | 2/2006 | Li | 450/82 |
| 7,001,240 | B1 * | 2/2006 | Huffman-Jimenez | 450/58 |
| 7,118,444 | B2 | 10/2006 | Newman | |
| 2005/0085161 | A1 | 4/2005 | Klakauskas | |

OTHER PUBLICATIONS

PCT search report dated Jun. 9, 2008.

* cited by examiner

*Primary Examiner*—Gloria Hale
(74) *Attorney, Agent, or Firm*—Shimokaji & Associates, P.C.

(57) ABSTRACT

An improved construction for a brassiere, wherein the brassiere is equipped with both back and front fasteners, and a multi-layered lining inside the cups to provide structure and support. The back and front fasteners enable the wearer to put the brassiere on with ease. The multi-layered lining, which absorbs body heat to mold to the shape of the breast accommodates the slight differences in size and shape in the breasts.

10 Claims, 6 Drawing Sheets

BRASSIERE

BACKGROUND OF THE INVENTION

The present invention generally relates to an improved construction of a brassiere and, more specifically, to a brassiere having posterior and anterior fasteners.

Brassieres come equipped to fasten either in the front or in the back. However, those who have a limited range of motion in their arms, shoulders or back, may have difficulty manipulating fasteners located in the back. Some may attempt to fasten the brassiere while wearing it backwards, then rotating it into its correct position. However, using this method may result in the breasts being improperly positioned in the brassiere.

Alternatively, brassieres may fasten in the front, between the breasts. Nevertheless, unlike brassieres which fasten in back, these brassieres are often constructed without fasteners which enable the wearer to adjust the tightness around the torso to accommodate for fluctuations in weight and size that may occur from month-to-month. Thus, the brassiere may be ill fitting or uncomfortable or not support the breasts.

In addition, many brassieres are constructed with an inner support system placed behind the cups. However, the inner support does not provide for flexibility so as to take into account the differences in the sizes and shapes of the breasts. Thus, the construction of the brassiere requires the breasts to conform to the shape of the brassiere, not vice versa.

As can be seen, there is a need for an improved brassiere which can be put on with ease, such as by those with impaired movement, and which takes into account the differentiations in the size and shape between the two breasts of a woman.

SUMMARY OF THE INVENTION

In one aspect of the present invention, a brassiere comprises a first cup-and-band section and a second cup-and-band section, both of which attach and detach anteriorly and posteriorly on the brassiere.

In another aspect of the present invention, two anterior cups for covering the breasts having medial ends affixed with detachable fasteners, wherein the anterior fasteners attach the medial ends of the two cup sections together; and two posterior bands affixed to each of the two anterior cups, adapted to attach to each other with detachable fasteners on the medial ends of the bands, wherein the posterior fasteners attach the two bands together.

In a further aspect of the present invention, a brassiere comprising fabric bands affixed with detachable posterior fasteners, an outer layer of breast covering cups having an outer surface and an inner surface, and an inner layer of multi-layered lining; wherein the bands are attached adjacent to the outer layer of breast covering cups; and wherein the multi-layered lining attached to the inner surface of the breast coverings cups further comprises ethyl vinyl acetate plastic and stretch knit fabric.

In an additional aspect of the present invention, a multi-layered lining for a brassiere, comprising ethyl vinyl acetate plastic and two or more layers of stretch knit fabric, wherein the lining may be attached to cups of the brassiere.

In yet another aspect of the present invention, a method for supporting breasts is disclosed. The method comprises the steps of: fastening posterior fasteners of a brassiere, placing fabric bands of a brassiere across the back of the torso, placing cups of the brassiere over the breasts, and fastening anterior fasteners of the brassiere.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention provides an improved construction for a brassiere. In particular, the present invention facilitates greater ease in putting on the brassiere, as the brassiere is equipped with both a front and back fastener. In addition, the brassiere is fitted with a soft, flexible, multi-layered lining which conforms to the shape of the wearer's breasts, as the material absorbs body heat to mold to the shape of the breasts.

Unlike other brassieres which are constructed with only a front fastener or only a back fastener, the present invention is equipped with both front and back fasteners. By having both front and back fasteners, the wearer is able to adjust the tightness of the fit around the torso by selecting one of a plurality of back fasteners. Once the back is fastened in the desired location, the wearer may place the back of the brassiere along the torso and bring the cups around to encompass the breasts, easily fastening the cups together using the front fasteners.

As used herein, the terms "anterior," "posterior," and "medial" may refer to directional positions on the human body. Accordingly, "anterior" may refer to the chest or front of the torso, and the term "posterior" may refer to the back or the back of the torso. Further, the term "medial" may refer to positioning located toward the center of the front or back of the torso. Therefore, the term "medial end" may refer to a terminal section of a brassiere that, when worn in its normal position, may be located near the center of the front of the torso or near the center of the back of the torso.

Figure 1:
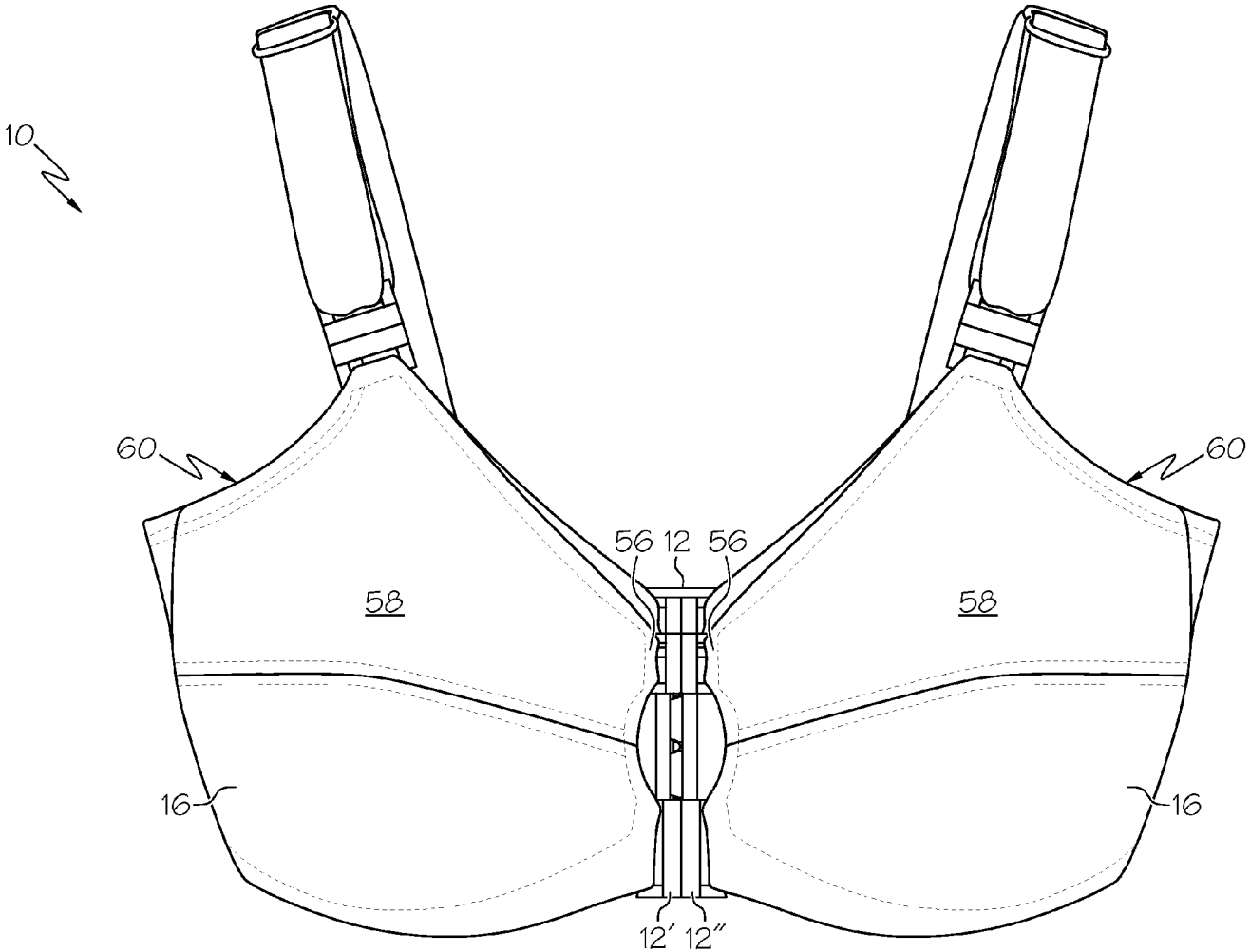
FIG. 1 is a front view of a brassiere, in a fastened state, in accordance with the present invention.
Figure 2:
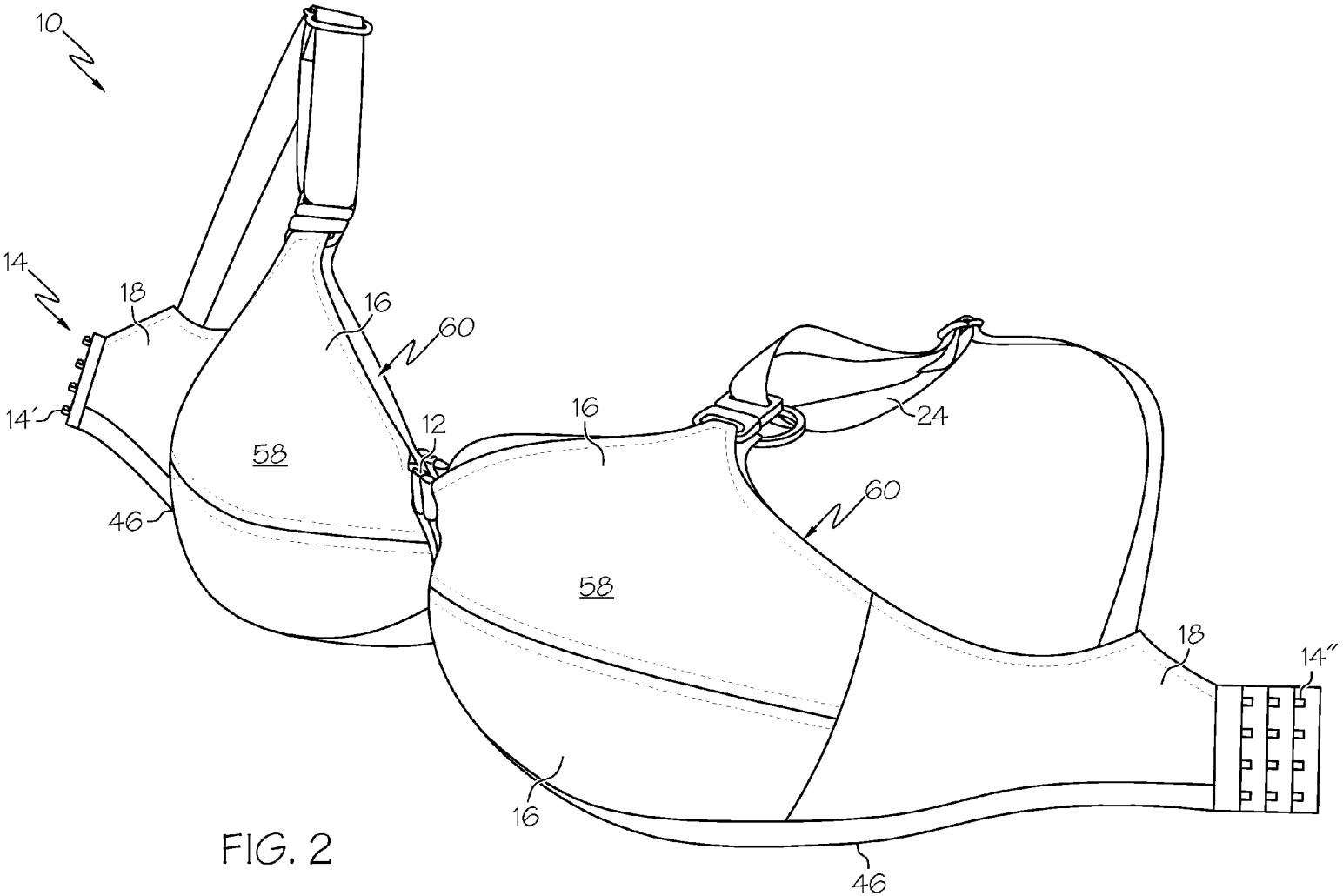
FIG. 2 is a perspective view of the brassiere of FIG. 1, in a partially unfastened state.

FIG. 1 is a front view of an exemplary embodiment of a brassiere 10 according to the present invention in a completely fastened state, posteriorly and anteriorly. FIG. 2 provides a perspective view of the brassiere 10 in FIG. 1, but showing the brassiere 10 in a partially unfastened state, posteriorly. Although the figures depict a brassiere adapted to be worn with shoulder straps, the invention is not limited as such, as strapless brassieres may also be contemplated by the present invention.

As shown in FIGS. 1 and 2, the brassiere 10 may be comprised of first and second anterior cups 16 each having an outer surface 58 and an inner surface 60 adapted to encompass and cover the breasts. The cups may be made of a soft, seamless flexible material such as a simplex style warp knit of polyester. A detachable anterior fastener 12, such as a clasp, may be affixed to medial ends 56 of the cups 16 to hold the cups 16 together. The anterior fastener 12 may include a first anterior fastener 12' affixed to a first medial end 56 and a second anterior fastener 12" affixed to a second medial end 56.

As better shown in FIG. 2, a first band 18 may be attached to the first cup 16 to form a first cup-and-band section 46. Further, a second band 18 may be attached to the second cup 16 to form a second cup-and-band section 46. Each of the bands 18 may be made of a material such as LYCRA® (spandex). The medial ends 54 of the bands 18 may be affixed together with a posterior fastener 14.

The posterior fastener 14 may be comprised of a first posterior fastener element 14' adapted to attach to a second posterior fastener element 14", such that the two bands 18 may be fastened together. In one embodiment, the detachable posterior fastener 14 may be comprised of two to five, typically three, hook and eye combinations. As an example, the fastener element 14' may be approximately two to five hooks, typically three, affixed to the first medial end 54 of the first band 18. In that case, the fastener element 14" may be multiple lines of corresponding eyes, between two to five, typically three, on the second medial end 54 of the second band 18.

Accordingly, the combination of hooks 14' and eyes 14" enable the user to adjust the tightness of the fit of the bands 18 (and thus the brassiere 10) around the torso, as the user may select which series of eyes 14" to thread the hooks 14' through to increase or decrease the tightness of the fit. Although FIG. 2 illustrates a hook and eye combination, alternative fasteners, such as clips and clasps may also be employed. Further, the positioning of the fasteners may also be reversed, such that the eyes are affixed to the first medial end of the first band, and the hooks are affixed to the second medial end of the second band.

Figure 3:
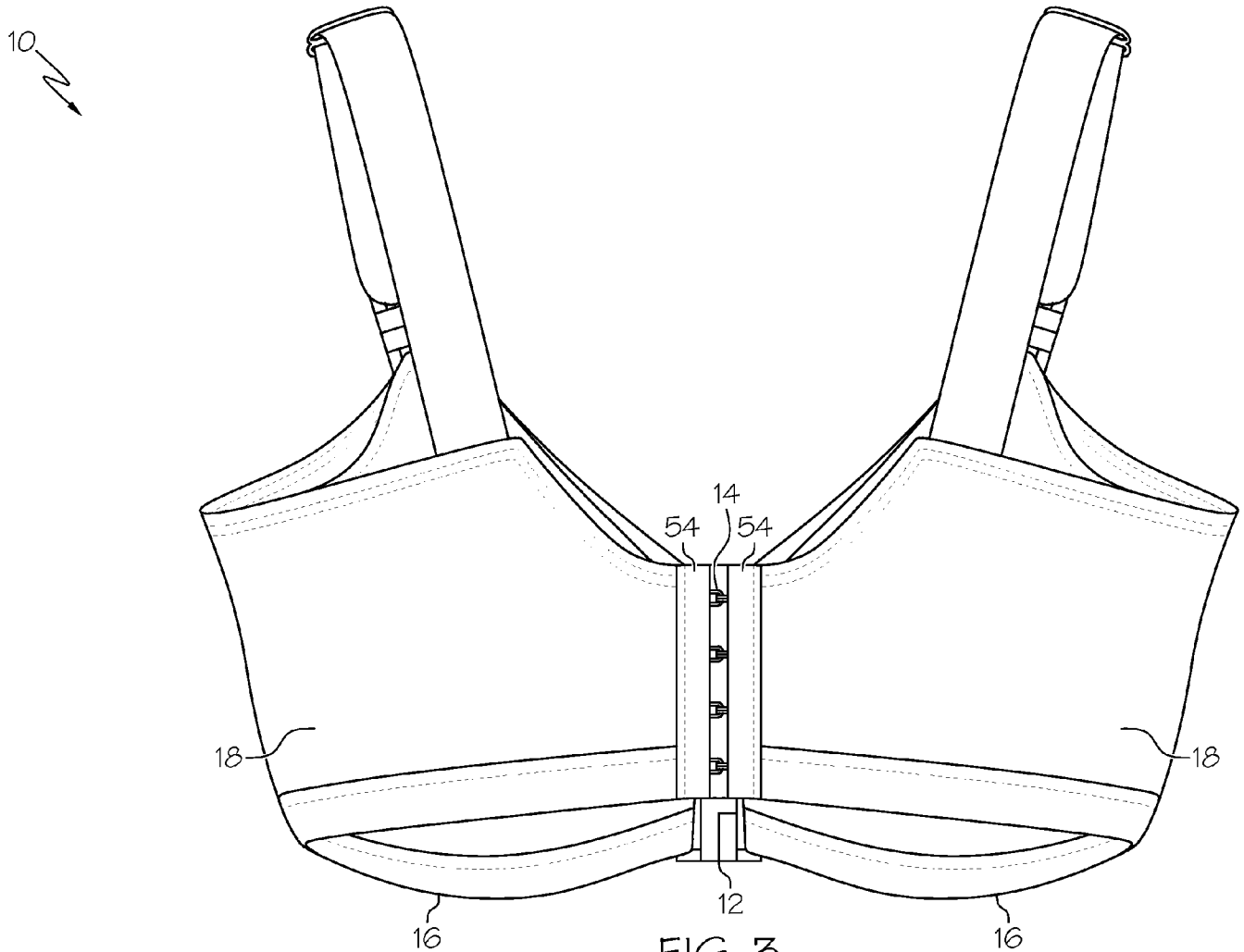
FIG. 3 is a back view of the brassiere of FIG. 1, in a fastened state.
Figure 4:
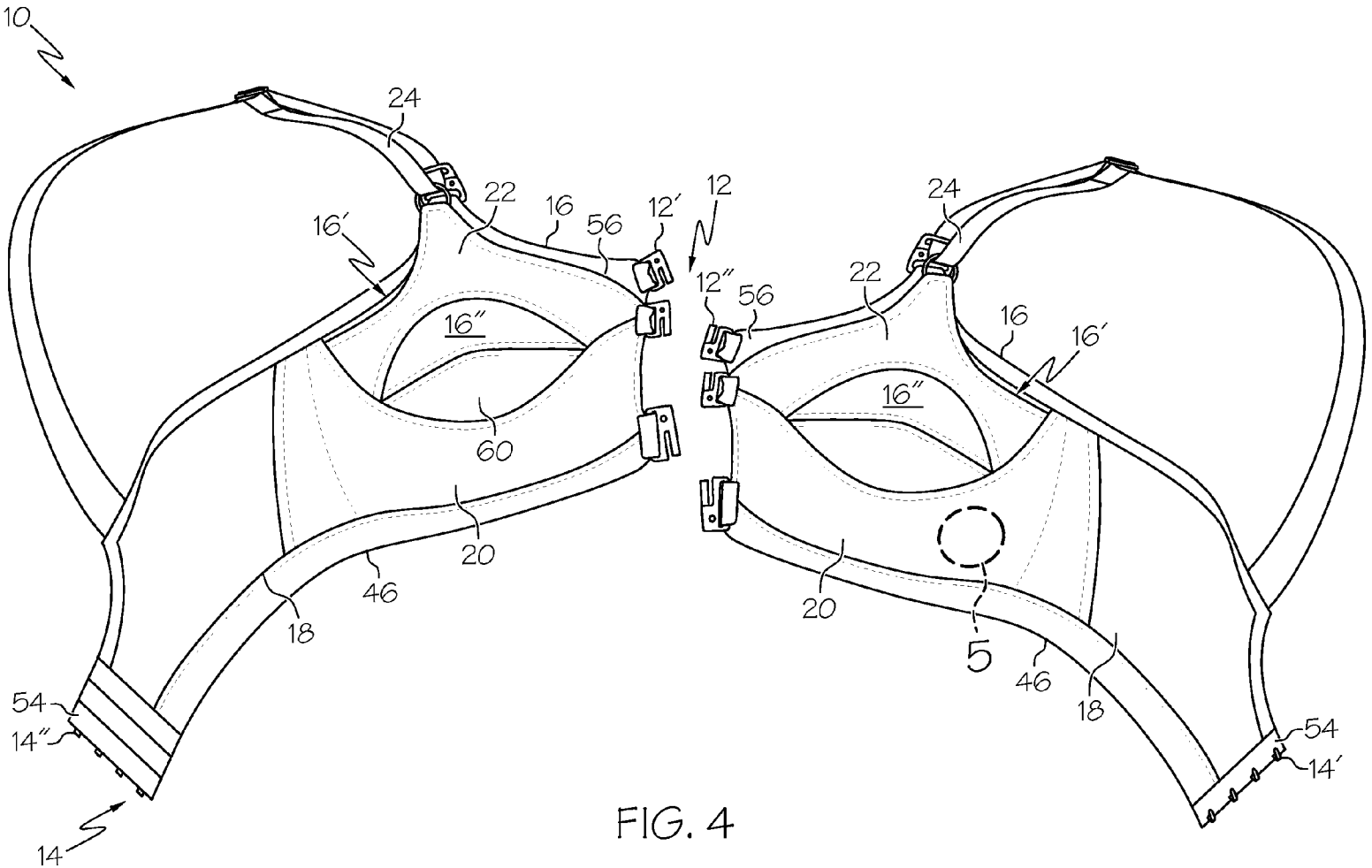
FIG. 4 is a back view of the brassiere of FIG. 1, in a completely unfastened state.

FIG. 3 is a back view of the brassiere 10 of FIG. 1 in a completely fastened state while FIG. 4 is a back view of the brassiere 10 in a completely unfastened state. As shown in FIG. 3, the two posterior bands 18 may be joined together by posterior fastener 14 located on the medial ends 54 to span and encompass the width of the back of the torso, thereby securing the cups 16 to the breasts, and the brassiere, as a whole, to the torso.

In FIG. 4, the anterior fastener 12 is shown as located on the medial ends 56 of the cups 16, and which fastener 12 holds the first and second cup-and-band sections 46 together anteriorly. The anterior fastener 12, pictured here as a clasp, may also be detached or fastened to allow for removal or use of the brassiere 10 by the user. As an alternative to a clasp, the anterior fastener 12 may be comprised of hooks, hook and eye combinations, or interlocking clips. Similarly, the posterior fastener 14 on the medial ends 54 of the bands 18 holds the medial ends 54 of the bands 18 together posteriorly, and the fastener 14 may be completely detached or fastened to allow for removal or use of the brassiere 10 by the user.

Still referring to FIG. 4, each cup 16 may include an upper portion 16' and a mid portion 16" which respectively interface and support the upper portions and mid portions of the breasts. An upper support band 22 may interface each upper portion 16' and be made of a soft, flexible material such as a simplex style warp knit of polyester. The support bands 22 may be adjustable to the breasts via shoulder straps 24.

In FIG. 4, a lower support band or multi-layer liner 20 may interface a lower portion of the inner surface 60 of the cups 16, in addition to a portion of the bands 18. Thereby, each breast may be supported at least by a cup 16, an upper support band 22, and lower support band 20. The support bands 20, support bands 22, and cups 16 may be affixed in the brassiere 10 such as by sewing. However, alternative methods of attachment, such as the use of adhesive, may also be employed.

Figure 5:
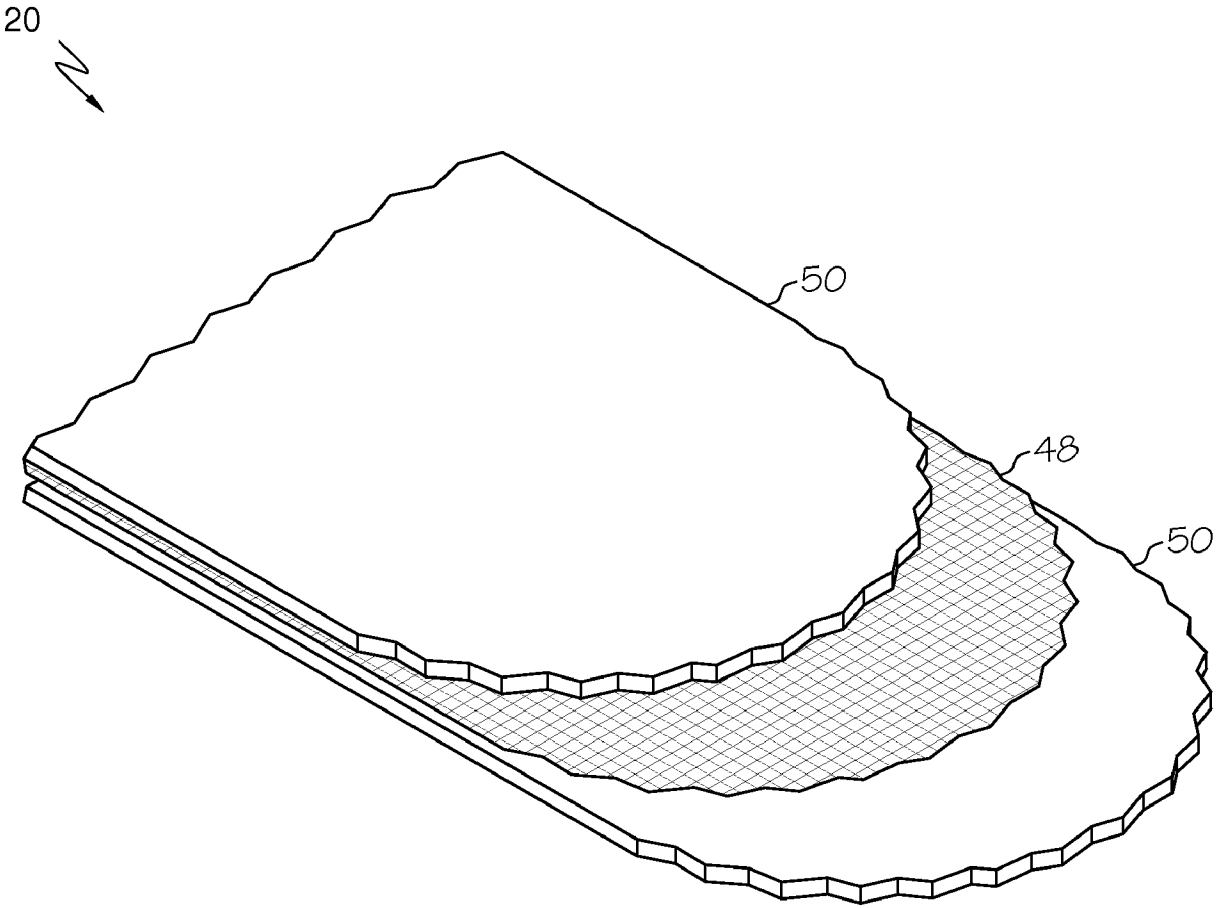
FIG. 5 is a perspective, exploded view of a multi-layered lining for use in a brassiere according to the present invention.

FIG. 5 is a perspective view of the lower support band or multi-layered liner 20, which may be used in the cups 16 to provide the breasts with support. The lower support band 20 may be comprised of ethyl vinyl acetate plastic 48 inserted between layers of fabric 50. The fabric 50 may be a stretch knit fabric. The lower support band 20 may respond to body heat so as to mold the band 20 to the shape of each breast, providing individualized, contoured support to each breast.

Figure 6:
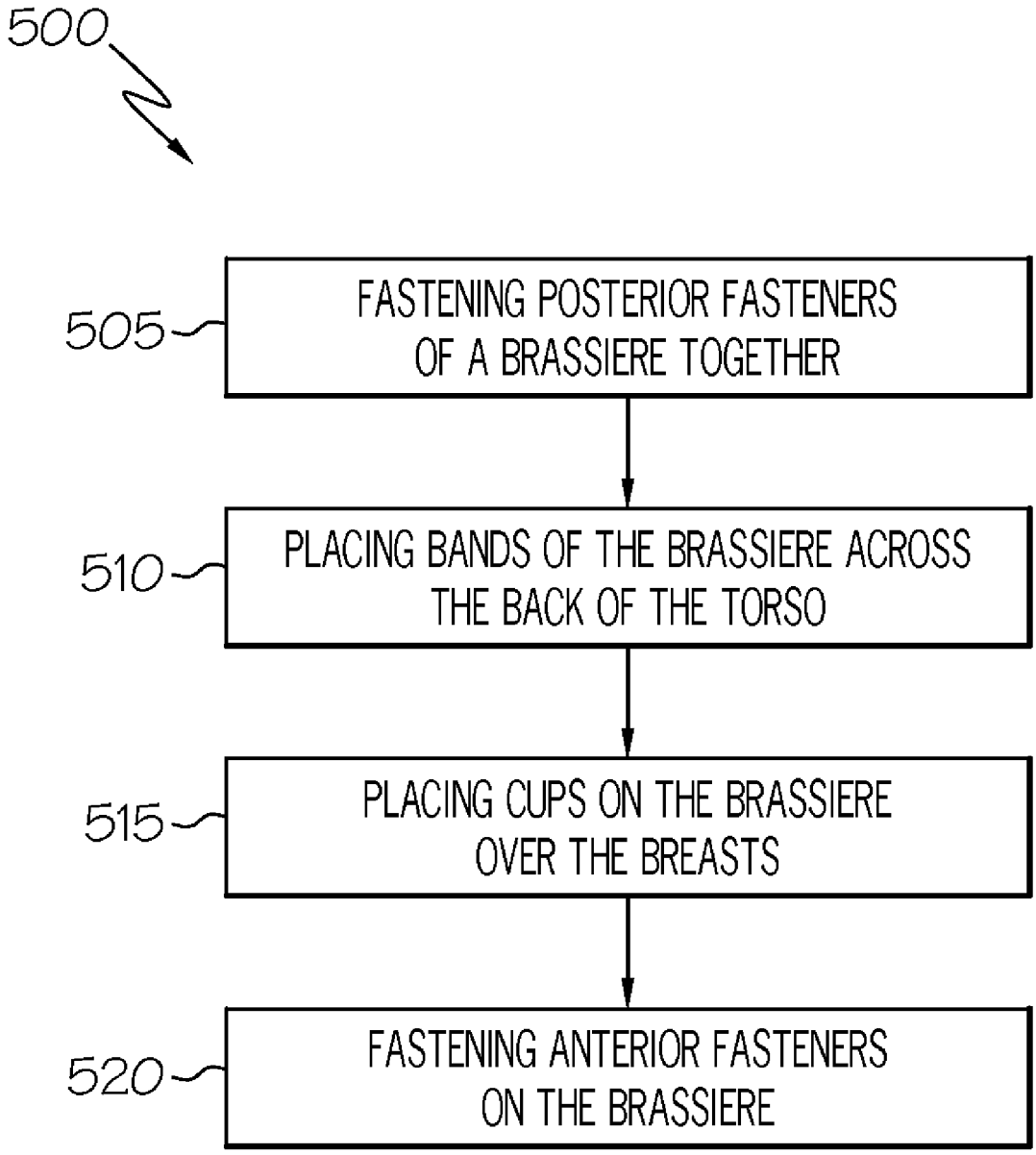
FIG. 6 is a flow chart of a method for supporting breasts with a brassiere according to the present invention.

FIG. 6 represents a flow chart for a method 500 of supporting breasts according to the present invention. In a step 505, a posterior fastener, such as fastener 14, of a brassiere, such as brassiere 10, may be fastened together. In a step 510, fabric bands, such as bands 18, of the brassiere may be placed across the back of the torso. In a step 515, cups of the brassiere, such as cups 16, may be placed over the breasts. At the same time, an upper support band, such as band 22 may interface upper portions of the breasts, while a lower support band, such as band 20, may interface lower portions of the breasts. In a step 520, an anterior fastener, such as fastener 12, of the brassiere may be fastened to secure the brassiere in place. In step 515, step 520, and/or later, the lower support band may conform to the shape of each breast to provide support. In so doing, the breasts may be better supported in comparison to a method whereby only a single fastener is used and/or no lower support band that conforms to the breast contour is used.

It should be understood, of course, that the foregoing relates to exemplary embodiments of the invention and that modifications may be made without departing from the spirit and scope of the invention as set forth in the following claims.

I claim:

1. A brassiere, comprising:

first and second bands;

a first cup attached to a first end of the first band, and a second, opposite end of the first band adapted to circumferentially extend to the posterior of the wearer;

A second cup attached to a first end of the second band, and a second, opposite end of the second band adapted to circumferentially extend to the posterior of the wearer, wherein each of the first cup and the second cup have inner surfaces adjacent to a wearer's breast;

a first and second lower support bands attached to respective first and second cups and interfacing a lower portion of the inner surface of a respective first and second cups;

wherein the lower support band includes an ethyl vinyl acetate plastic between layers of stretch knit fabric.

2. The brassiere of claim 1, further comprising first and second upper support bands attached to the first end of respective first and second bands and interfacing an upper portion of the inner surface.

3. The brassiere of claim 1, further comprising an anterior fastener between the first and second cups to provide a front opening brassiere.

4. The brassiere of claim 1, further comprising a posterior fastener at the second end of each of the first and second bands to provide a rear opening brassiere.

5. A brassiere, comprising:

first and second cups;

a first and second multilayer liners adjacent and attached to a lower portion on an inner surface of each respective first and second cups adjacent a skin surface of a wearer's breast, wherein the multilayer liner includes:

an ethyl vinyl acetate plastic; and a stretch knit fabric that sandwiches the plastic.

6. The brassiere of claim 5, further comprising first and second bands, wherein a first end of each of the first and second bands are attached to the first and second cups and where a second, opposite end of each of the first and second bands are adapted to circumferentially extend to a posterior of the wearer and attach to each other.

7. A method engaging a brassiere including both posterior and anterior detachably engaging fasteners for supporting breasts, the method comprising:

fastening said posterior fastener of said brassiere;

placing bands of the brassiere across a back of a torso;

placing cups of the brassiere over the breasts;

fastening the anterior fastener of the brassiere; and contouring a liner of the brassiere to a lower portion of the breasts, the liner including an ethyl vinyl acetate a plastic sandwiched between layers of stretch knit fabric, wherein the liner interfaces a lower portion of each of the cups and wherein said plastic contours to a shape of a wearer's breast in response to a body heat.

8. A brassiere, comprising:

first and second cups attachable both posteriorly and anteriorly;

first and second bands, wherein each band has a first end attached to each respective cup and a second end adapted to circumferentially extend to and connect at a posterior of a wearer; and a lower support band that interfaces a lower portion of each of the first and second cups;

wherein the lower support band adjacent to a skin surface of a wearer's breast and includes an ethyl vinyl acetate a heat responsive plastic that molds to the contour of a breast within a corresponding cup.

9. The brassiere of claim 8, wherein said lower support band further includes a knit material.

10. The brassiere of claim 8, wherein said lower support band includes a multi-layer structure having ethyl vinyl acetate plastic sandwiched between layers of a fabric.

* * * * *